US009857728B2

(12) United States Patent
Murata

(10) Patent No.: US 9,857,728 B2
(45) Date of Patent: Jan. 2, 2018

(54) TONER CONTAINER ATTACHABLE TO AND DETACHABLE FROM IMAGE FORMING APPARATUS

(71) Applicant: KYOCERA Document Solutions Inc., Osaka-shi, Osaka (JP)

(72) Inventor: Koji Murata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/209,629

(22) Filed: Jul. 13, 2016

(65) Prior Publication Data

US 2017/0023879 A1 Jan. 26, 2017

(30) Foreign Application Priority Data

Jul. 23, 2015 (JP) ..... 2015-146006

(51) Int. Cl.
*G03G 15/08* (2006.01)

(52) U.S. Cl.
CPC ..... *G03G 15/0872* (2013.01); *G03G 15/0865* (2013.01); *G03G 15/0879* (2013.01); *G03G 15/0886* (2013.01)

(58) Field of Classification Search
CPC ..... G03G 15/0836; G03G 15/0837; G03G 15/0867; G03G 15/0868; G03G 15/087; G03G 15/0872
See application file for complete search history.

(56) References Cited

U.S. PATENT DOCUMENTS 4,611,899 A * 9/1986 Kasamura ..... G03G 15/0872 399/12
4,740,808 A * 4/1988 Kasamura ..... G03G 15/0872 399/12
4,803,521 A * 2/1989 Honda ..... G03G 21/1896 399/111
5,870,652 A * 2/1999 Kanamori ..... G03G 15/0822 399/106
6,023,594 A * 2/2000 Okiyama ..... G03G 15/0872 399/112

(Continued)

FOREIGN PATENT DOCUMENTS

JP 2008129141 A 6/2008

*Primary Examiner* — Carla Therrien
(74) *Attorney, Agent, or Firm* — Alleman Hall Creasman & Tuttle LLP

(57) ABSTRACT

A toner container is attachable to and detachable from a toner supply portion of an image forming apparatus. The toner container includes an attaching portion configured to be engaged with an attached portion of the toner supply portion such that the toner container is selectively attached to the toner supply portion. The attached portion includes an engaged portion around which first interruption keys are disposed. The attaching portion includes an engaging portion and a plurality of key members. The engaging portion is configured to be engaged with the engaged portion. The key members are larger in number than the first interruption keys and include second interruption keys formed in correspondence with the first interruption keys. Among the key members, the second interruption keys that interrupt with the first interruption keys are cut so that the engaging portion and the engaged portion can be engaged with each other.

6 Claims, 7 Drawing Sheets

(56) References Cited

U.S. PATENT DOCUMENTS

| | | | | |
|---|---|---|---|---|
| 8,000,614 | B2 * | 8/2011 | Okino | G03G 15/0872 399/111 |
| 9,211,720 | B2 * | 12/2015 | Boyd | B41J 2/1752 |
| 2007/0269224 | A1 * | 11/2007 | Sato | G03G 15/0863 399/12 |
| 2008/0118254 | A1 | 5/2008 | Kawai | |
| 2011/0058857 | A1 * | 3/2011 | Hori | G03G 15/0886 399/262 |

* cited by examiner

TONER CONTAINER ATTACHABLE TO AND DETACHABLE FROM IMAGE FORMING APPARATUS

INCORPORATION BY REFERENCE

This application is based upon and claims the benefit of priority from the corresponding Japanese Patent Application No. 2015-146006 filed on Jul. 23, 2015, the entire contents of which are incorporated herein by reference.

BACKGROUND

The present disclosure relates to a toner container attachable to a toner supply portion of an image forming apparatus, and in particular relates to a toner container that can selectively realize the attachment compatibility with the toner supply portion.

An electrophotographic image forming apparatus includes a developing device. Developer containing toner is stored in the inside of the developing device. The image forming apparatus includes a toner supply portion to which toner containers are attached. In the state where the toner containers are attached to the toner supply portion, toner can be supplied from the toner containers to the developing device.

There is known a conventional image forming apparatus that has an incompatibility structure that allows only toner containers having attachment compatibility to be attached to the toner supply portion so that toner of different colors cannot be supplied to the toner supply portion. Image forming apparatuses of this type are configured such that toner of different colors cannot be supplied to the toner supply portion. Specifically, the toner supply portion is provided with main-body-side compatible key portions that include compatible keys that correspond to toner containers that can be attached to the toner supply portion. On the other hand, the toner containers include incompatible members that can be engaged with only the main-body-side compatible key portions of the toner supply portion that correspond to the toner containers, and cannot be engaged with the other toner supply portions.

SUMMARY

A toner container according to an aspect of the present disclosure is attachable to and detachable from a toner supply portion of an image forming apparatus. The toner container includes an attaching portion configured to be engaged with an attached portion provided in the toner supply portion such that the toner container is selectively attached to the toner supply portion, the attached portion including an engaged portion around which first interruption keys are disposed. The attaching portion includes an engaging portion and a plurality of key members. The engaging portion is configured to be engaged with the engaged portion. The plurality of key members are larger in number than the first interruption keys and include second interruption keys formed in correspondence with the first interruption keys. Among the key members, the second interruption keys that interrupt with the first interruption keys are cut so that the engaging portion and the engaged portion can be engaged with each other.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes, with reference to the drawings, an image forming apparatus 10 and a toner container 41 which is applied to the image forming apparatus 10. In the following description, for the sake of explanation, an up-down direction D1 is defined based on the state where the image forming apparatus 10 is installed. In addition, a front-rear direction D2 is defined such that a side at which insertion of the toner container 41 to the image forming apparatus 10 is performed is the front side. Furthermore, a left-right direction D3 is defined based on the image forming apparatus 10 viewed from the front side.

[Image Forming Apparatus]

The image forming apparatus 10 has at least a print function and is, for example, a color printer. The image forming apparatus 10 prints an image on a print sheet that is a sheet member, by using developer containing toner. A specific example of the image forming apparatus 10 is, for example, a printer, a copier, a facsimile, or a multifunction peripheral having functions of these apparatuses. In addition, although the image forming apparatus 10 is configured to form a color image, the image forming apparatus of the present disclosure may be configured to form a monochrome image as far as it uses the toner container 41.

Figure 1:
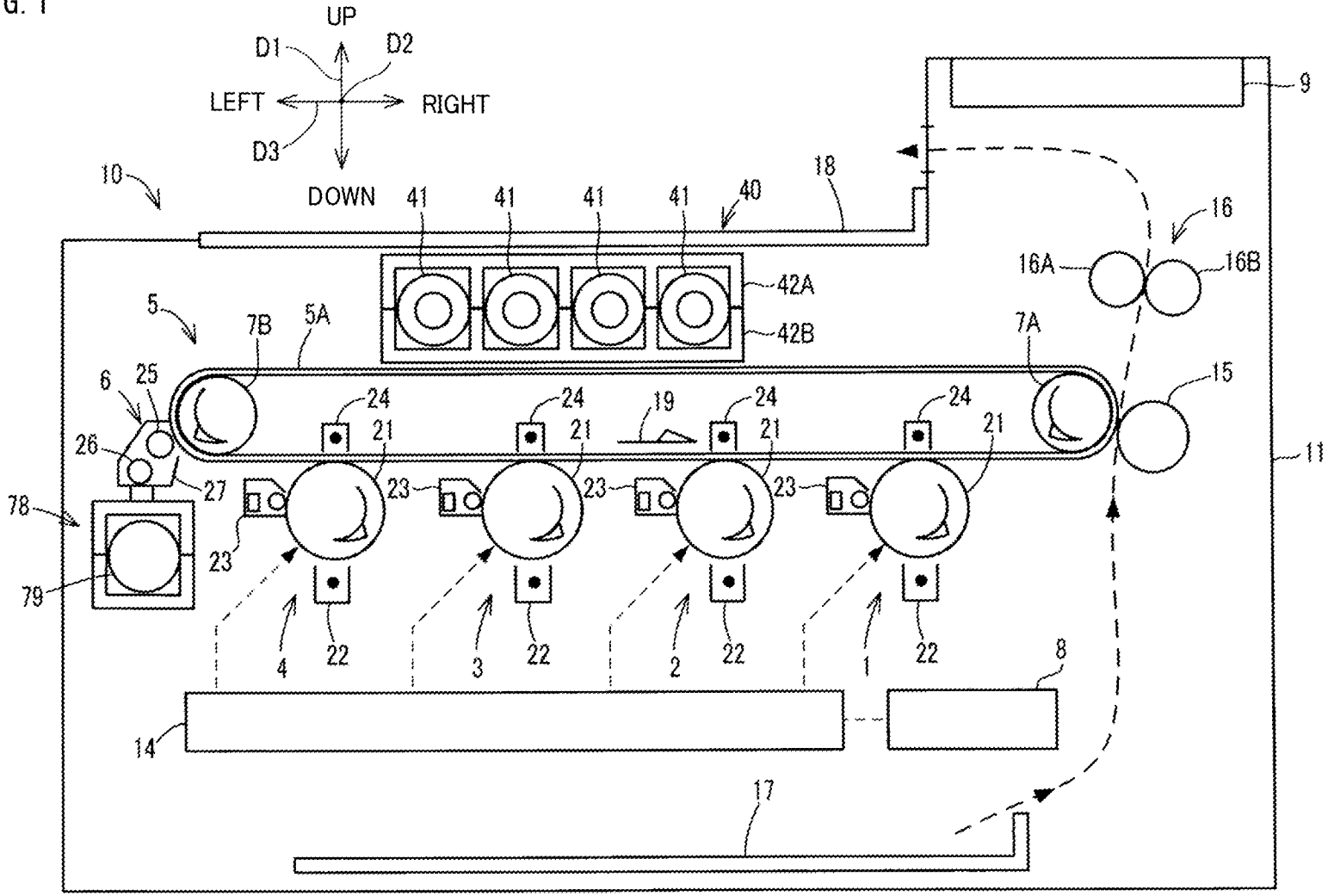
FIG. 1 is a diagram showing a configuration of an image forming apparatus.

As shown in FIG. 1, the image forming apparatus 10 is a so-called tandem color image forming apparatus. The image forming apparatus 10 includes a plurality of image forming portions 1 to 4, an intermediate transfer unit 5, an exposure device 14, a secondary transfer device 15, a fixing device 16, a toner supply device 40 (an example of the toner supply portion of the present disclosure), a belt cleaning device 6, a waste toner collecting device 78, an operation/display portion 9 including a touch panel, a liquid crystal display portion and the like, a control portion 8, a sheet feed tray 17, and a sheet discharge tray 18. These components are attached to a housing 11 that constitutes an external frame (not shown), an internal frame and the like of the image forming apparatus 10.

The image forming portions 1 to 4 respectively form toner images of different colors on a plurality of photoconductor drums 21 that are arranged in alignment, by a so-called electrophotography. The toner images are transferred to an intermediate transfer belt 5A while it is running (moving) such that the toner images are overlaid with each other. In the example shown in FIG. 1, the image forming portions 1 to 4 for black, yellow, cyan, and magenta are arranged in alignment in the stated order from the downstream side in the moving direction (direction indicated by the arrow 19) of the intermediate transfer belt 5A.

The image forming portions 1 to 4 are provided below the intermediate transfer belt 5A. Each of the image forming portions 1 to 4 includes a photoconductor drum 21 carrying a toner image thereon, a charging device 22, a developing device 23, and a primary transfer device 24. The surface of the photoconductor drum 21 is charged by the charging device 22, and the charged surface of the photoconductor drum 21 is exposure-scanned by the exposure device 14. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 5A by the primary transfer device 24.

The intermediate transfer unit 5 includes the intermediate transfer belt 5A, a driving roller 7A, and a driven roller 7B. The intermediate transfer belt 5A carries a toner image that is formed from toner images of a plurality of (in the present embodiment, four) colors. The intermediate transfer belt 5A is supported and rotationally driven by the driving roller 7A and the driven roller 7B so as to move while its surface is in contact with surfaces of the photoconductor drums 21. When the intermediate transfer belt 5A is rotationally driven, its surface passes between the photoconductor drums 21 and the primary transfer devices 24. During that movement, the toner images of the different colors carried on the plurality of photoconductor drum 21 are transferred in sequence to the intermediate transfer belt 5A in such a way as to be overlaid with each other.

The toner supply device 40 is provided above the intermediate transfer unit 5. The toner supply device 40 is configured to store four toner containers 41 for colors of black, yellow, cyan, and magenta that are attached thereto in a detachable manner. The configuration of the toner supply device 40 is described below.

The secondary transfer device 15 transfers the toner image from the intermediate transfer belt 5A to a print sheet conveyed from the sheet feed tray 17. The print sheet on which the toner image is transferred is conveyed by a conveyance portion (not illustrated) to the fixing device 16. The fixing device 16 includes a heating roller 16A and a pressure roller 16B. The fixing device 16 conveys the print sheet on which the toner image has been transferred, while applying heat and pressure thereto. This allows the toner image to be fused and fixed to the print sheet. The print sheet to which the toner image has been fixed is further conveyed toward the downstream side, and discharged to and held by the sheet discharge tray 18 that is disposed above the intermediate transfer unit 5.

The belt cleaning device 6 collects waste toner, namely toner that has remained on the surface of the intermediate transfer belt 5A, and conveys the collected waste toner to the waste toner collecting device 78. The belt cleaning device 6 is disposed on the left side of the intermediate transfer unit 5. The belt cleaning device 6 includes a cleaning roller 25 that is the cleaning member, a screw member 26, and a toner box 27. The cleaning roller 25 is disposed to face the driven roller 7B, and its surface is in contact with the intermediate transfer belt 5A. The length of the cleaning roller 25 in the front-rear direction D2 is approximately the same as that of the intermediate transfer belt 5A. The cleaning roller 25 is rotatably supported in the toner box 27. The cleaning roller 25 is rotated when a rotational driving force is input to the shaft of the cleaning roller 25.

The cleaning roller 25 is rotated while it is in contact with the intermediate transfer belt 5A, thereby removing toner that has remained on the surface of the intermediate transfer belt 5A after the transfer by the secondary transfer device 15. Hereinafter, the toner that has been removed by the cleaning roller 25 is referred to as "waste toner". The waste toner is taken into the toner box 27 by the action of gravity or by the rotation of the cleaning roller 25, and collected therein. The waste toner collected in the toner box 27 is conveyed by the screw member 26. A discharge port (not illustrated) is formed on the bottom of the toner box 26 on the rear end side. The waste toner is conveyed in the toner box 27 toward the discharge port as the screw member 26 is rotated.

The waste toner collecting device 78 is provided below the toner box 27. The waste toner collecting device 78 is configured to store the waste toner container 79 that is attached thereto in a detachable manner. When the waste toner is discharged from the discharge port of the belt cleaning device 6, the waste toner is reserved in the waste toner container 79 attached to the waste toner collecting device 78. That is, the toner that has remained on the surface of the intermediate transfer belt 5A is removed by the belt cleaning device 6 and then stored in the waste toner container 79 as the waste toner. In the present embodiment, an empty toner container 41 that was used in the toner supply device 40 can be used as the waste toner container 79 as well.

[Toner Supply Device]

Figure 2:
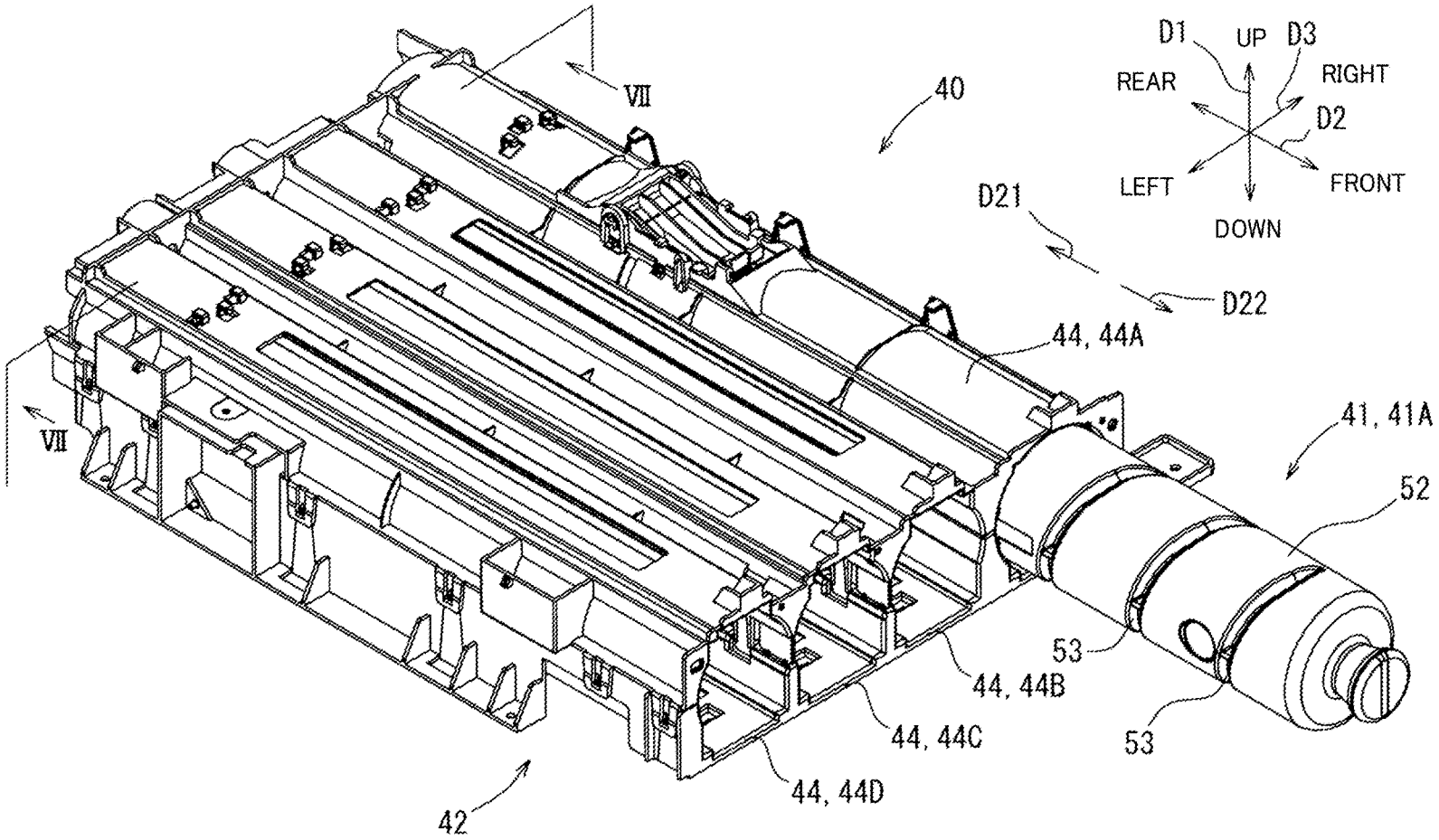
FIG. 2 is a perspective view of a toner supply device included in the image forming apparatus.
Figure 3:
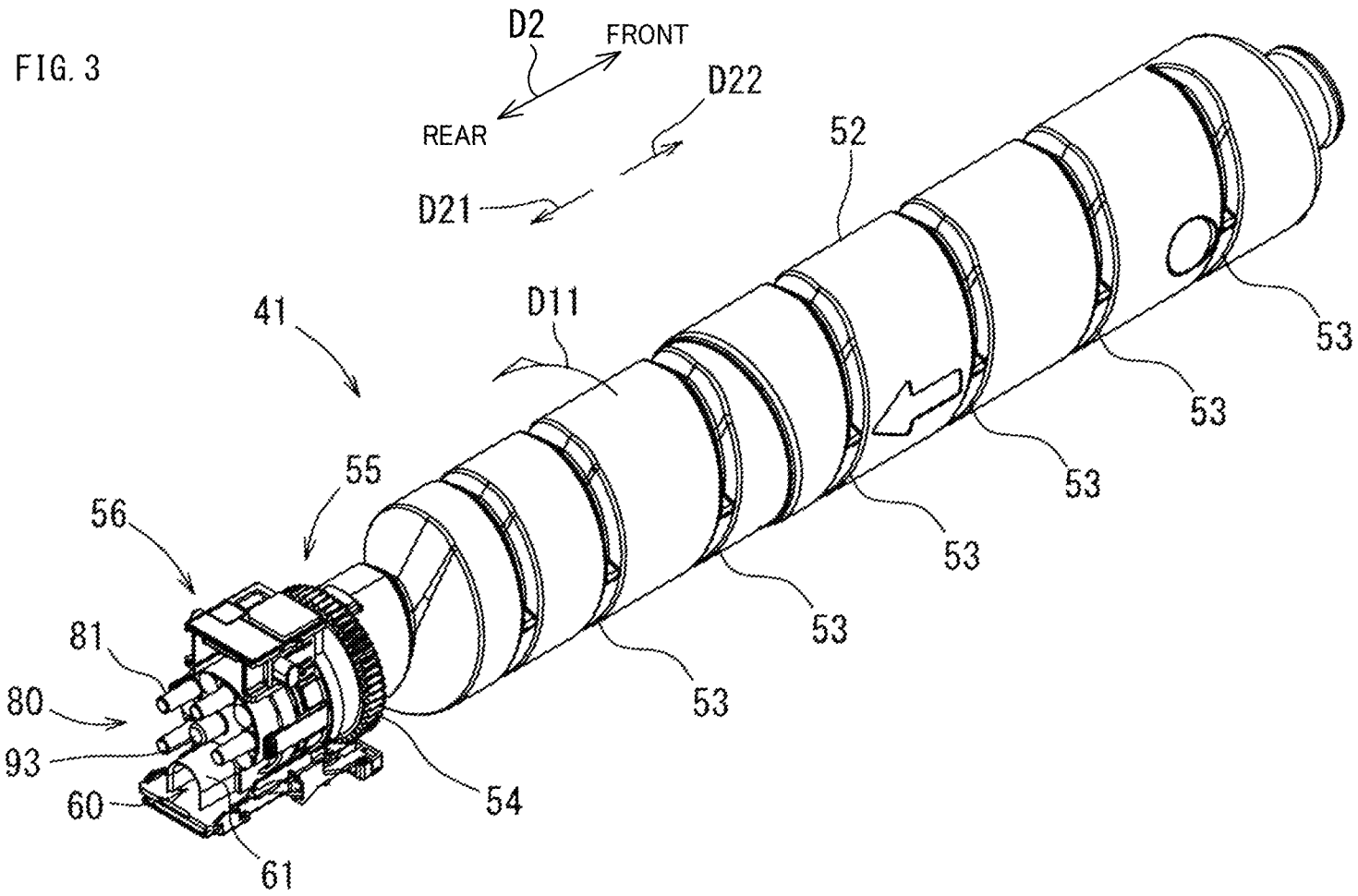
FIG. 3 is a perspective view of a toner container according to an embodiment of the present disclosure.

In the following, the toner supply device 40 is described with reference to FIG. 2 to FIG. 11. As shown in FIG. 2, the toner supply device 40 includes toner containers 41 and a container attachment portion 42 to which the toner containers 41 are attached. It is noted that in these drawings, based on the attachment attitude where the toner supply device 40 is attached to the housing 11, the vertical direction is defined as the up-down direction D1, the attachment/detachment (insertion/removal) direction of the toner containers 41 to/from the housing 11 is defined as the front-rear direction D2, and the horizontal direction viewed from the front of the toner supply device 40 is defined as the left-right direction D3.

The toner containers 41 store toner that is to be supplied to the developing device 23. In the present embodiment, four toner containers 41 corresponding to the colors of black, yellow, cyan and magenta are provided in the toner supply device 40. It is noted that the toner container 41 for black has a larger external diameter than the toner containers 41 for the other colors, but except for this, all the toner containers 41 have the same configuration. In the following description, the toner container 41 refers to the toner container 41 for black unless otherwise mentioned.

The toner container 41 is elongated in the front-rear direction D2. The toner container 41 includes a container main body 52, a drive transmission portion 55, and a cover member 56. The inside of the toner container 41 is a storage space for storing toner. Toner is stored in the inside of the toner container 41. The container main body 52 has, at one end (a rear end) thereof, an opening portion 51 (see FIG. 5) through which toner can flow in and out. The opening portion 51 is formed at an end (a rear end) in an insertion direction D21 in which the toner container 41 is inserted in the toner supply device 40. The toner stored in the inside can flow out to outside from the opening portion 51. The container main body 52 is cylindrical, and the other side (front side) thereof is closed.

The rear-end portion of the container main body 52 is formed in a tapered shape that is tapered in the insertion direction D21. The opening portion 51 is formed in the rear end of the container main body 52 in the insertion direction D21. The opening portion 51 is circular in a cross section. The container main body 52 is formed from, for example, synthetic resin such as polyethylene terephthalate (PET resin) by the blow molding method or the injection molding method.

The container main body 52 includes an angled rib 53 (see FIG. 3) that is formed in a spiral shape on the inner surface of the container main body 52. The angled rib 53 projects from the inner surface of the container main body 52 toward the center of the container main body 52. The angled rib 53 has a role of conveying the toner in the container main body 52 toward the opening portion 51 (see FIG. 5).

Figure 4:
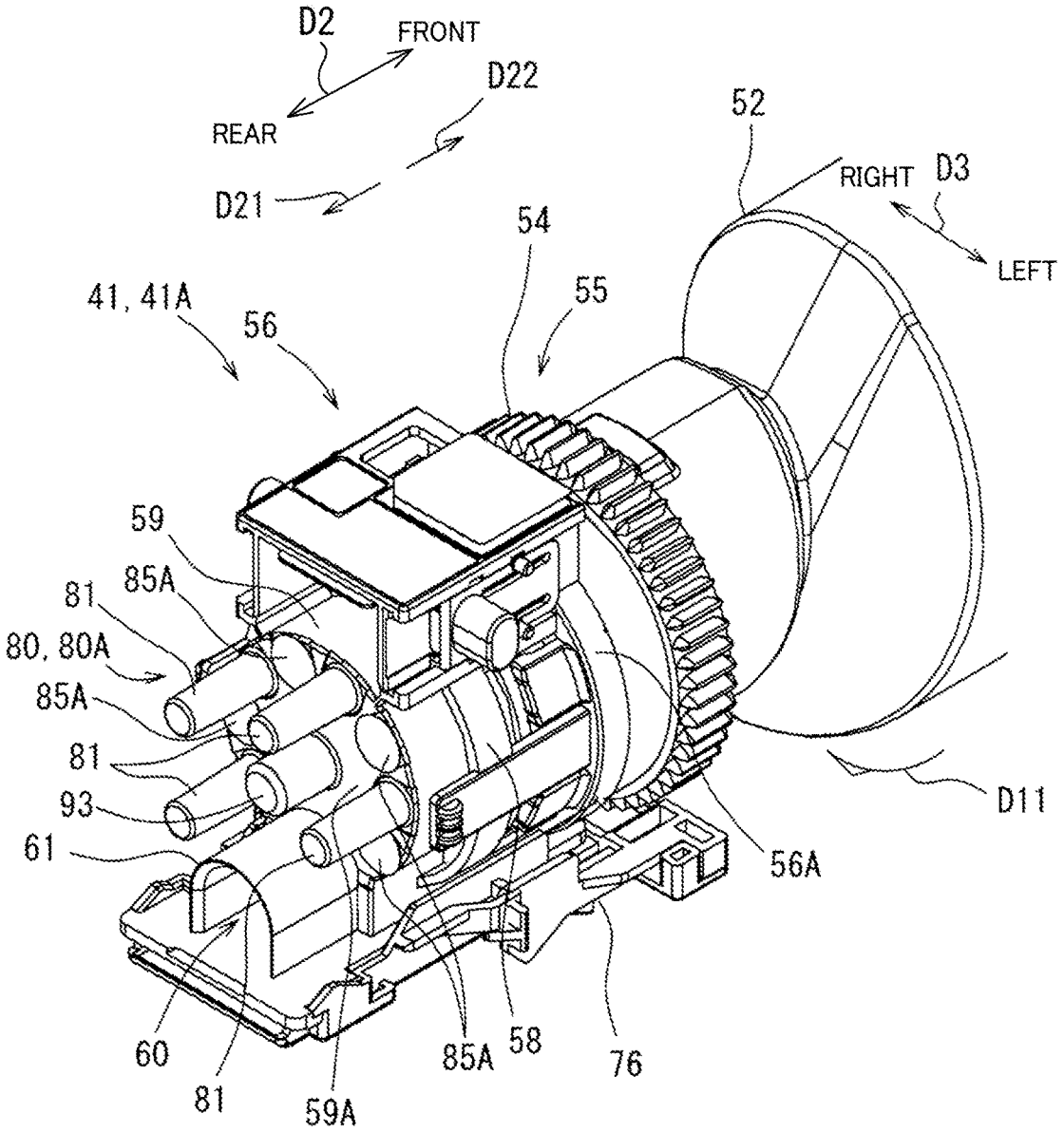
FIG. 4 is an enlarged perspective view of a cover member of the toner container.

As shown in FIG. 4, the drive transmission portion 55 is attached to the opening portion 51 side of the container main body 52. The drive transmission portion 55 is fixed to the container main body 52. The drive transmission portion 55 is an annular member with a gear 54 formed on its circumferential surface. The drive transmission portion 55 is fitted in an end portion of the container main body 52 on the opening portion 51 side, and is fixed to the circumferential surface thereof. Upon receiving a rotational driving force from a drive source such as a motor, the drive transmission portion 55 transmits the rotational driving force to the toner container 41.

In the container main body 52, the cover member 56 is provided more on the leading end side in the insertion direction D21 (more on the rear side) than the drive transmission portion 55. The cover member 56 is provided to cover the opening portion 51, and is attached to the container main body 52 at an end in the insertion direction D21 (on the rear side). The cover member 56 is a synthetic resin product formed from a synthetic resin having thermoplasticity, by the injection molding or the like.

Figure 5:
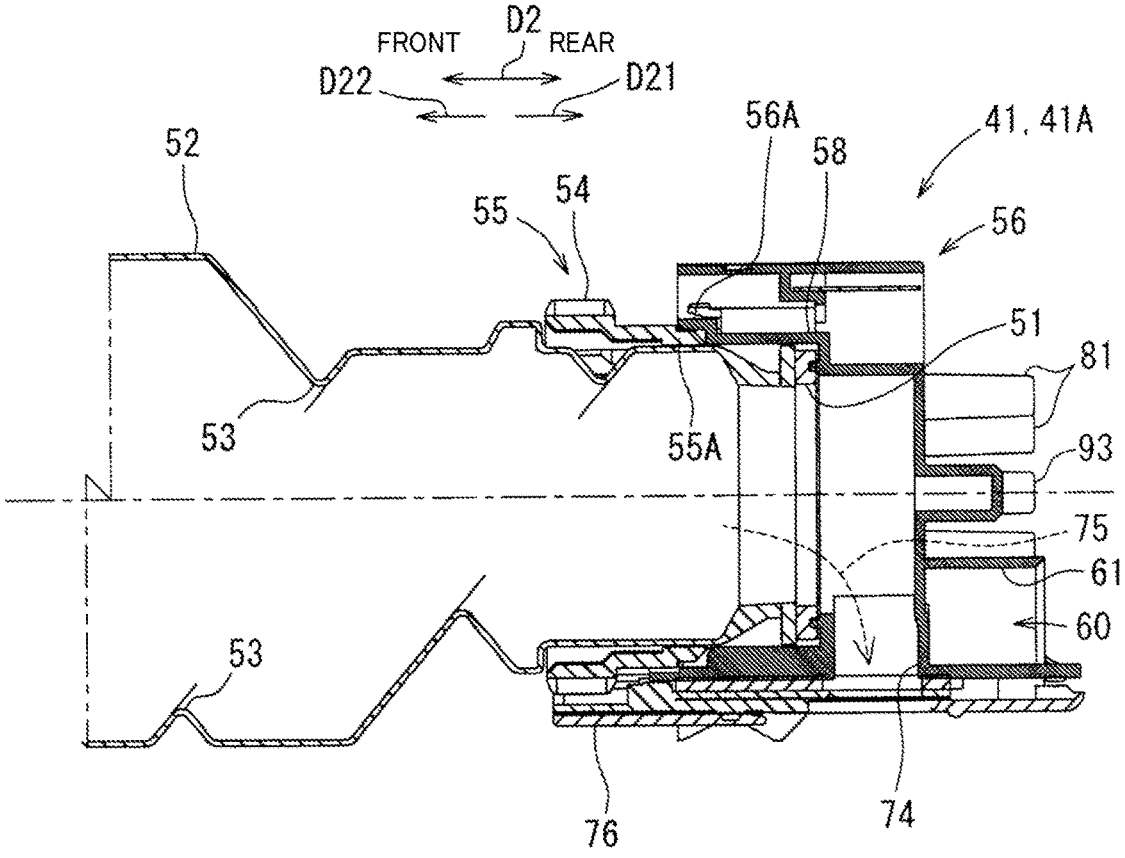
FIG. 5 is a cross-sectional view of the cover member of the toner container.

The cover member 56, in the state of being attached to the container main body 52, includes a storage frame 58 of a cylindrical shape in which the opening portion 51 (see FIG. 5) is inserted. As shown in FIG. 5, the opening portion 51 is inserted in the storage frame 58 so as to be covered therewith. The storage frame 58 supports the opening portion 51 in such a manner that the opening portion 51 can pivot in the circumferential direction. As a result, in the state where the opening portion 51 is inserted in the storage frame 58, the container main body 52 can pivot in the circumferential direction. When the toner container 41 is attached to the container attachment portion 42, an attaching portion 80 is engaged with an attached portion 90 as described below, and the cover member 56 is fixed in the circumferential direction of the toner container 41. As a result, in the state where the toner container 41 is attached to the container attachment portion 42, the cover member 56 supports the opening portion 51 side of the container main body 52 so as to be pivotable in the circumferential direction. A front end portion 56A of the cover member 56 is loosely fitted on a rear end portion 55A of the drive transmission portion 55 (see FIG. 5). As a result, when, in the state where the toner container 41 is attached to the container attachment portion 42, the rotational driving force is transmitted to the gear 54, the container main body 52 is rotated by the rotational driving force in a rotation direction indicated by the arrow D11 (see FIG. 4). That is, the toner container 41 rotates around its longitudinal direction in the state where toner can be supplied to the developing device 23. When the container main body 52 of the toner container 41 rotates in this way, the toner is pressed by the angled rib 53 and conveyed toward the opening portion 51 side (the rear side).

The cover member 56 includes a toner discharge port 74 (see FIG. 5). The toner discharge port 74 is provided to discharge the toner stored in the container main body 52 to the outside, and is provided in the outer circumferential wall of the cover member 56. The toner discharge port 74 is provided below the cover member 56 in FIG. 5. Specifically, the toner discharge port 74 is a rectangular through hole penetrating through the wall of the cover member 56. As shown in FIG. 5, a toner flow path 75 (an example of the guide path of the present disclosure) is formed inside the cover member 56 between the opening portion 51 and the toner discharge port 74. When the toner container 41 is attached to the container attachment portion 42 (see FIG. 2) with the toner discharge port 74 on the lower side, the toner, having moved from the opening portion 51 of the container main body 52 to the toner flow path 75, is guided through the toner flow path 75 downward and reaches the toner discharge port 74. Here, when the toner discharge port 74 is opened, the toner is discharged from the toner discharge port 74 to the lower outside. This allows the toner to be supplied to the developing device 23. On the other hand, when the toner discharge port 74 is closed, the toner is not discharged, and the toner flow path 75 is filled with toner.

As shown in FIG. 5, the cover member 56 includes a slide-type opening/closing member 76. The opening/closing member 76 is a plate-like member, and is supported by the cover member 56 in such a way as to be slidable in the longitudinal direction of the container main body 52 (the front-rear direction D2). The opening/closing member 76 opens or closes the toner discharge port 74 depending on the position of the toner container 41 with respect to the container attachment portion 42. When the toner container 41 is attached to the container attachment portion 42, the opening/closing member 76 opens the toner discharge port 74. Specifically, when the toner container 41 is attached to the container attachment portion 42, the opening/closing member 76 receives a pressing force of the attachment operation from the container attachment portion 42, and is moved to a position (opening position) where the opening/closing member 76 opens the toner discharge port 74. FIG. 5 shows a state where the opening/closing member 76 has moved to the front side and opened the toner discharge port 74. When the toner container 41 is removed from the container attachment portion 42, the opening/closing member 76 is moved rearward by the removal operation, from the opening position to a position (closing position) where the opening/closing member 76 closes the toner discharge port 74. It is noted that the container attachment portion 42 includes a biasing member (not illustrated), and the movement of the opening/closing member 76 from the opening position to the closing position is realized as the biasing member causes the opening/dosing member 76 to move relatively rearward in response to the removal operation of the toner container 41.

The cover member 56 includes a base portion 59 more on the leading end side in the insertion direction D21 than the storage frame 58, wherein the base portion 59 is cylindrical and hollow inside. The base portion 59 is integrally formed with the attaching portion 80 (an example of the attaching portion of the present disclosure) that is described later. On an end surface 59A of the base portion 59 at an end in the insertion direction D21, an arch-shaped guide wall 61 is provided so as to project from the end surface 59A. A hole 60 surrounded by the guide wall 61 is a portion in which is inserted a coil spring (not illustrated) that is held by a spring seat 94 (see FIG. 7) formed on an innermost surface 46 of each of storage portions 44 when the toner container 41 is attached to one of the storage portions 44, wherein the storage portions 44 are described below. In addition, a projection 93 (an example of the engaging portion of the present disclosure) is integrally formed with the end surface 59A at the center of the end surface 59A. The projection 93 is engaged with a hole 92A of a protruding boss 92 (an example of the engaged portion of the present disclosure) formed on the innermost surface 46, when the toner container 41 is attached to one of the storage portions 44. Specifically, the projection 93 is inserted in the hole 92A. This allows the projection 93 and the protruding boss 92 to be engaged with each other, and the toner container 41 is positioned with respect to the storage portion 44. It is noted that, when the toner container 41 is attached to the storage portion 44, the coil spring is inserted, in the state of being contracted, in the hole 60. Thus, the toner container 41 is locked at an attachment position in the storage portion 44 by a locking mechanism (not illustrated) so that the toner container 41 is not released by the spring force of the coil spring.

As shown in FIG. 2, the container attachment portion 42 includes four storage portions 44 (44A to 44D). The storage portions 44 respectively store the toner containers 41 of predetermined colors. The rightmost storage portion 44A stores the toner container 41 for black. FIG. 2 shows a state where a part of the rear-side portion of the toner container 41 for black is inserted in the storage portion 44. The storage portions 44B, 44C and 44D disposed on the left side of the storage portion 44A store toner containers 41 for yellow, cyan and magenta, respectively.

The image forming apparatus 10 is configured such that a toner container 41 for a different color cannot be attached to the corresponding storage portion 44. That is, only a toner container 41 having attachment compatibility with a corresponding storage portion 44 can be attached to the storage portion 44. That is, each storage portion 44 selectively allows a toner container 41 having attachment compatibility therewith to be attached thereto. In the present embodiment, the attaching portion 80 is provided on the tip of the toner container 41 in the insertion direction D21, and the attached portion 90 (an example of the attached portion of the present disclosure) is provided in the innermost surface 46 (see FIG. 7) of the storage portion 44 on the rear side. When a toner container 41 is inserted in a storage portion 44, and the attaching portion 80 of the toner container 41 is engaged with the attached portion 90, the attachment of the toner container 41 is permitted. On the other hand, when the attaching portion 80 of the toner container 41 is not engaged with the attached portion 90, the attachment of the toner container 41 is prohibited. Such a configuration for realizing the attachment compatibility between the attached portion 90 and the attaching portion 80 is referred to as an incompatibility structure, in general.

A general incompatibility structure requires a plurality of types of incompatible members in correspondence with the respective colors. Thus, for example, in the image forming apparatus 10 using toners of four colors, namely, black, yellow, cyan and magenta, four types of incompatible members are required. Preparing a plurality of incompatible members individually increases the number of parts. In addition, when a plurality of incompatible members are molded from resin by using dies, four types of dies are required, which is a big burden for the initial cost. In addition, in a general incompatibility structure, additional parts such as identification engaging members or identification protruding members are required, in addition to the toner containers and the toner supply portions. As a result, it is impossible for the general incompatibility structure to restrict an increase in the number of parts, and an additional cost is required for the additional parts. On the other hand, the present embodiment realizes the incompatibility structure with a configuration where the attaching portions 80 of the plurality of toner containers 41 for different colors have a shape common to the different colors, and a partial element (incompatible key) of the attaching portions 80 is cut as necessary. In the following, the configurations of the attached portions 90 of the storage portions 44 and the attaching portions 80 of the toner containers 41 are described in detail.

Figure 7:
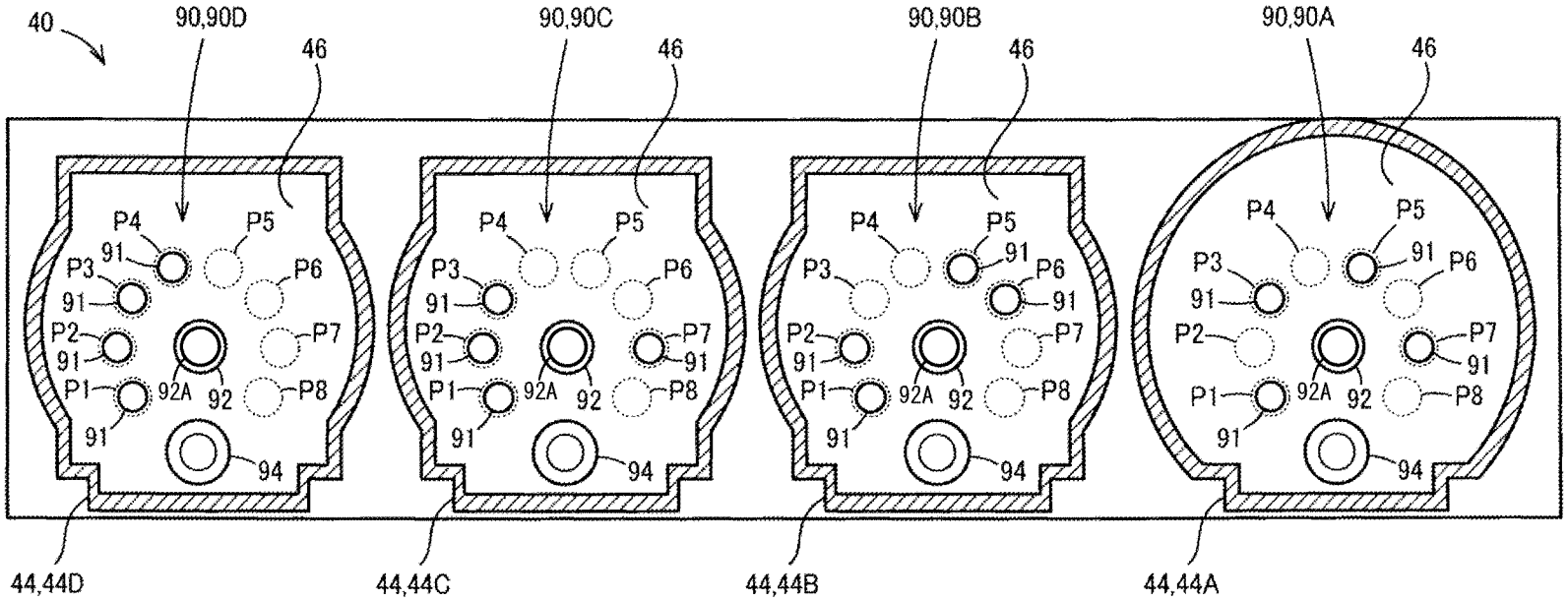
FIG. 7 is a schematic cross sectional view taken along a cut plane VII-VII of FIG. 2.

FIG. 7 is a schematic cross sectional view taken along a cut plane VII-VII of FIG. 2. FIG. 7 shows the innermost surfaces 46 of the storage portions 44 disposed at an end in the insertion direction D21. A plurality of attached portions 90 (90A to 90D) corresponding to the plurality of colors are respectively provided in the storage portions 44. The attached portions 90 are respectively provided on the innermost surfaces 46. The attached portions 90 are configured to be engaged with the attaching portions 80 of the toner containers 41 that have the attachment compatibility therewith. The attached portions 90, by being engaged with the attaching portions 80, realize a selective attachment of the toner containers 41 to the storage portions 44.

Each of the attached portions 90 includes protruding portions 91 (an example of the first interruption keys of the present disclosure) at positions among eight positions Pk (P1 to P8) (see dotted-line circles in FIG. 7) that are preset on the innermost surface 46. The protruding portions 91 are bar-like members that project from the innermost surface 46 in a direction perpendicular to the innermost surface 46. As shown in FIG. 7, a circular protruding boss 92 is formed at the center of the innermost surface 46. The protruding boss 92 is a cylindrical member projecting frontward from the innermost surface 46. A hole 92A is formed at the center of the tip surface of the protruding boss 92. The hole 92A is a portion into which the projection 93 for positioning provided on the end surface 59A of the cover member 56 is inserted. On the innermost surface 46, the spring seat 94 for holding a coil spring (not illustrated) is provided below the protruding boss 92. An end of the coil spring is held by the spring seat 94. The coil spring held by the spring seat 94 is inserted in a hole 60 formed in the cover member 56 of the toner container 41, when the toner container 41 is attached to the storage portion 44. The positions P1 to P8 are set on the circumference of a circle around the protruding boss 92. In the present embodiment, the positions P1 to P8 are the same positions in each of the four innermost surfaces 46, and are set on the circumference at an equal angle interval based on the center point. In the example shown in FIG. 7, on the innermost surface 46, the position P1 is set to be adjacent to the spring seat 94 in the CW (clockwise) direction, and the positions P2 to P8 are set at an equal angle interval from the position P1 in the CW direction. It is noted that position P8 is set to be adjacent to the spring seat 94 in the CCW (counterclockwise) direction. As shown in FIG. 7, the positions P1 to P8 are arranged symmetrically with respect to a vertical line passing through the center of the protruding boss 92.

Each of the attached portions 90 provided on the innermost surfaces 46 includes four protruding portions 91. For example, on an innermost surface 46 of a storage portion 44A to which a toner container 41 for black is attached, an attached portion 90A is provided. The attached portion 90A includes protruding portions 91 at positions P1, P3, P5 and P7 among the positions P1 to P8. That is, in the attached portion 90A, the protruding portions 91 are erected at the positions P1, P3, P5 and P7.

On an innermost surface 46 of a storage portion 44B to which a toner container 41 for yellow is attached, an attached portion 90B is provided. The attached portion 90B includes protruding portions 91 at positions P1, P2, P5 and P6. That is, in the attached portion 90B, the protruding portions 91 are erected at the positions P1, P2, P5 and P6.

On an innermost surface 46 of a storage portion 44C to which a toner container 41 for cyan is attached, an attached portion 90C is provided. The attached portion 90C includes protruding portions 91 at positions P1, P2, P3 and P7. That is, in the attached portion 90C, the protruding portions 91 are erected at the positions P1, P2, P3 and P7.

On an innermost surface 46 of a storage portion 44D to which a toner container 41 for magenta is attached, an attached portion 90D is provided. The attached portion 90D includes protruding portions 91 at positions P1, P2, P3 and P4. That is, in the attached portion 90D, the protruding portions 91 are erected at the positions P1, P2, P3 and P4.

In the present embodiment, when a toner container 41 having attachment compatibility with a storage portion 44 is inserted in the storage portion 44, compatible keys 81 of the attaching portion 80 of the toner container 41 are located at positions Pk at which no protruding portion 91 is provided in the attached portion 90. In addition, the compatible keys 81 are not provided at positions that correspond to positions Pk at which protruding portions 91 are provided. As a result, the compatible keys 81 do not abut on and interrupt with the protruding portions 91. Thus, the insertion of the toner container 41 in the insertion direction D21 is not restricted.

FIG. 4 shows the tip portion of the toner container 41 for black which is inserted in a storage portion 44A for black. In the following, for the sake of explanation, the toner container 41 for black is referred to as a toner container 41A, and the attaching portion 80 provided thereon is referred to as an attaching portion 80A. As shown in FIG. 4, the attaching portion 80A is provided on the tip portion of the toner container 41A in the insertion direction D21. The attaching portion 80 is provided on each of the toner containers 41 for yellow, cyan and magenta, as well as on the toner container 41A for black, and the attaching portions 80 are formed in different shapes. In the following, as a representative for the attaching portion 80 for the respective colors, the toner container 41A for black is described with reference to FIG. 4.

As shown in FIG. 4, the attaching portion 80A is integrally formed with the cover member 56 of the toner container 41A. The cover member 56 includes the base portion 59 that is cylindrical and is hollow inside, more on the leading end side in the insertion direction D21 than the cylindrical storage frame 58. The attaching portion 80A is provided on the end surface 59A (an example of the facing surface of the present disclosure) of the base portion 59 that is on the leading end side in the insertion direction D21. The attaching portion 80A is integrally formed with the cover member 56 by molding. The attaching portion 80A includes four compatible keys 81. The four compatible keys 81 are positioned so as to be engaged with the attached portions 90A for black. The compatible keys 81 are protruding members that project from the end surface 59A in the insertion direction D21 (namely, toward the attached portions 90A), and are each formed in the shape of a bar whose cross section is circular. When the attaching portions 80A are integrally formed with the cover member 56, the compatible keys 81 are formed to be hollow inside so as to be communicable with the inside of the toner container 41A. The inside of each compatible key 81 communicates with the toner flow path 75 of the cover member 56, and communicates with the inside of the toner container 41A via the toner flow path 75.

In the present embodiment, the compatible keys 81 are formed on the end surface 59A at positions corresponding to the positions P2, P4, P6 and P8 on the attached portion 90A where the protruding portions 91 are not provided, when the toner container 41A is inserted in the storage portion 44A and the attached portion 90A and the end surface 59A face each other.

Since the attaching portion 80A is provided in the toner container 41A as described above, when the toner container 41A is inserted in the corresponding storage portion 44A, the compatible keys 81 are located at the positions P2, P4, P6 and P8 on the attached portion 90A where the protruding portions 91 are not provided. This enables the toner container 41A to be attached to the storage portion 44A, without the compatible keys 81 being interrupted by the protruding portions 91. In other words, the toner container 41A has the attachment compatibility with the storage portion 44A. It is noted that in the state where the toner container 41A is attached to the attaching portion 80, the compatible keys 81 and the protruding portions 91 are engaged in the circumferential direction of the toner container 41A. As a result, by this engagement, the cover member 56 is fixed in the circumferential direction of the toner container 41A.

Figure 6A:
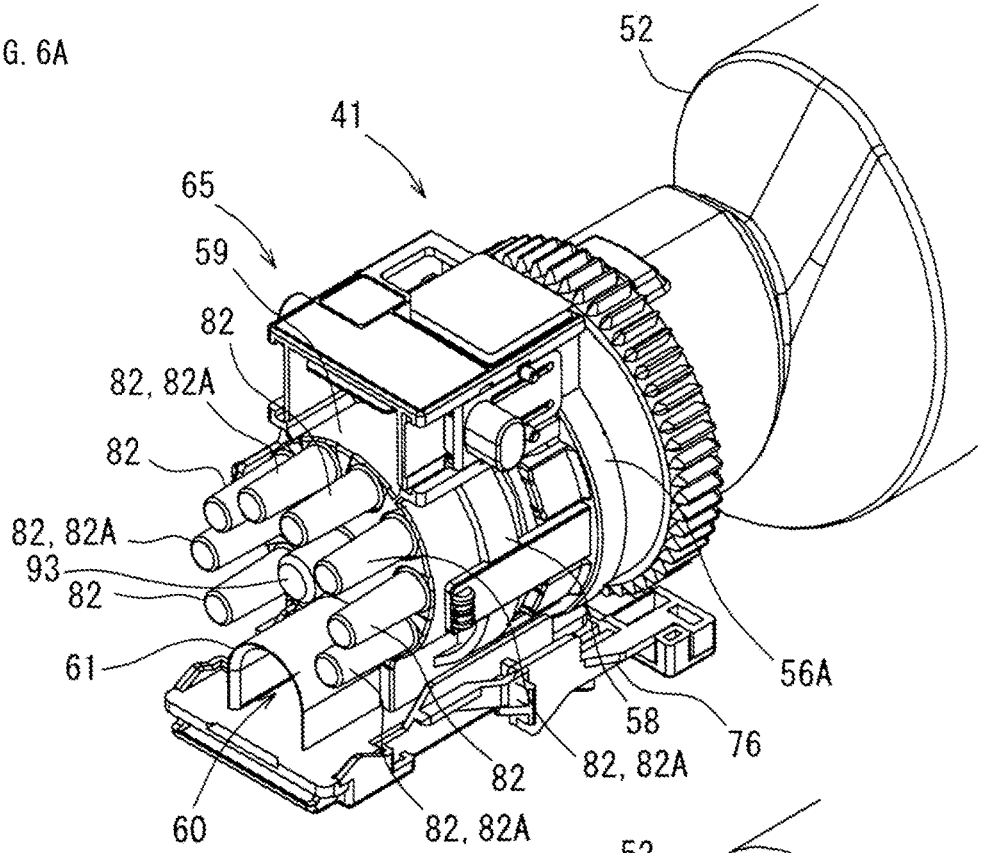
FIG. 6A is a diagram showing the cover member before projections are cut.

The above-described attaching portion 80A can be formed as follows. That is, as shown in FIG. 6A, a cover member 65 is formed by molding on the base portion 59 such that eight protruding members 82 (an example of the key members of the present disclosure) of the same shape as the compatible keys 81 are provided thereon at positions corresponding to the positions P1 to P8. The cover member 65 is a base for forming the cover members 56 that have the attachment compatibility with corresponding storage portions 44. In the present embodiment, the base portion 59 having the eight protruding members 82 on the end surface 59A is integrally formed with the cover member 65. The base portion 59 is a base member for forming the attaching portion 80A. The cover member 65 has the same configuration as the cover member 56 except that it has eight protruding members 82, and is formed by molding from synthetic resin having plasticity as is the case with the cover member 56. In the present embodiment, it is possible to form, based on the cover member 65, the cover members 56 that include the attaching portions 80 having the attachment compatibility in correspondence with the respective colors.

Specifically, when a cover member 56 to be attached to the toner container 41A for black is formed from the cover member 65, four protruding members 82A (an example of the second interruption keys of the present disclosure) that correspond to the positions P1, P3, P5 and P7 at which the protruding portions 91 are formed on the attached portion 90A of the storage portion 44A, are selected, and the selected four protruding members 82A are cut (see FIG. 6A). The four protruding members 82A formed on the end surface 59A at positions corresponding to the positions P1, P3, P5 and P7 would interrupt with the protruding portions 91 provided on the innermost surface 46 at the positions P1, P3, P5 and P7 when the toner container 41A is attached to the storage portion 44A. As a result, the interrupting four protruding members 82A are cut, and the protruding members 82A that do not interrupt with the protruding portions 91 are left. This enables the toner container 41A to be attached to the storage portion 44A, and the projection 93 to be engaged with the hole 92A of the protruding boss 92. As the cutting method, for example, a method of cutting by an ultrasonic cutter, or a method of cutting by a cutter using laser beams may be applied. Alternatively, a slit may be made at the base of the protruding members 82A during molding, and unnecessary protruding members 82A may be broken and removed. The protruding members 82 that are left after the cutting become the compatible keys 81.

If the selected protruding members 82A were not cut, they would interrupt with the protruding portions 91. That is, if the attaching portion 80 of the cover member 56 of the toner container 41A includes at least one of the protruding members 82A, the protruding member 82A abuts on any of the protruding portions 91 at the positions P1, P3, P5 and P7 when the toner container 41A is inserted in the storage portion 44A. As a result, the protruding member 82A of the attaching portion 80 is not engaged with the attached portion 90A. Of course, due to the presence of the protruding member 82A, the other protruding members 82 cannot be engaged with the attached portion 90A although they are intended to be engaged with the attached portion 90A originally. In this way, the protruding member 82A inhibits, by the interruption, the engagement with the attached portion 90A. When the four protruding members 82A are cut, the attaching portion 80A that can be engaged with the attached portion 90A is formed.

Figure 6B:
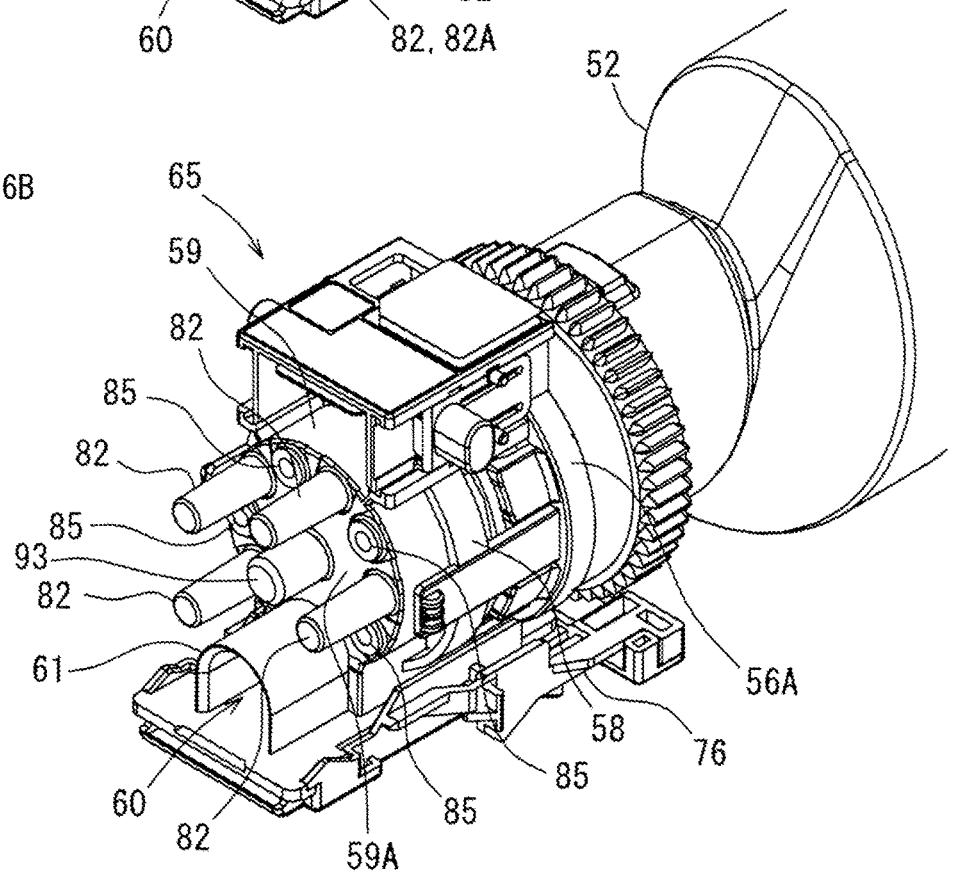
FIG. 6B is a diagram showing the cover member after some projections are cut.

As described above, each protruding member 82A has the same shape as the compatible keys 81 and is hollow inside. As a result, as shown in FIG. 6B, when the protruding members 82A are cut, openings 85 are made. Since the openings 85 communicate with the toner flow path 75, the toner in the toner flow path 75 would flow out to outside via the openings 85. As a result, after the protruding members 82A are cut, the openings 85 are closed by the heat welding. FIG. 4 shows closed portions 85A that are openings 85 closed by the heat welding. Since the cover member 65 is made of synthetic resin having thermoplasticity, when, for example, an impulse welding machine is used to heat-weld the cut surfaces, the rims of the openings 85 melt and the openings 85 are filled therewith, and after being cooled thereafter, the openings 85 are closed.

Up to now, an example case has been described where the cover member 56 for black is formed from the cover member 65. However, it is possible to form, from the cover member 65, a cover member 56 that includes the attaching portion 80 that has the attachment compatibility with another attached portion 90. That is, among the eight protruding members 82 of the cover member 65, protruding members 82 that correspond to the positions at which the protruding portions 91 are provided on the attached portion 90 targeted for the attachment compatibility, may be selectively cut, and protruding members 82 that correspond to the positions at which the protruding portions 91 are not provided, may be left. This makes it possible to form attaching portions 80 that have the attachment compatibility with the attached portions 90. This realizes the incompatibility where a toner container 41 can be attached to a storage portion 44 of a corresponding color as far as the cover member 56 including this attaching portion 80 is attached to the toner container 41, and attachment of the toner container 41 to another storage portion 44 of another color is prohibited.

As described above, it is possible to form various attaching portions 80 from one type of cover member 65. As a result, it is possible to form, easily from the cover member 65, cover members 56 that have attaching portions 80 of different shapes that correspond to the colors of the toner containers 41. This makes it possible to reduce the number of parts, compared to the case where the cover members 56 are formed individually. In addition, in the case where the cover members 56 are formed by molding in dies, only one die is required for molding the cover member 65. As a result, it is possible to restrict the burden for the initial cost.

According to the above-described embodiment, the attached portion 90 includes four protruding portions 91 and the attaching portion 80 includes four compatible keys 81, as one example. However, the number and positions of the protruding portions 91 and the compatible keys 81 are not limited to those of the above-described configuration. In addition, according to the above-described embodiment, the attaching portion 80 is provided on the cover member 56, as one example. However, the attaching portion 80 may be integrally formed with the container main body 52 of the toner container 41 if the toner container 41 does not include the cover member 56.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container attachable to and detachable from a toner supply portion of an image forming apparatus, the toner container comprising:

an attaching portion configured to be engaged with an attached portion provided in the toner supply portion such that the toner container is selectively attached to the toner supply portion, the attached portion including an engaged portion around which at least one first protruding portion is disposed, wherein the attaching portion is formed from resin and includes:

an engaging portion configured to be engaged with the engaged portion; and a compatible key provided on a facing surface of the attaching portion at a position where the compatible key does not contact the first protruding portion at an attachment of the toner container to the toner supply portion, the compatible key protruding from the facing surface toward the attached portion and the facing surface facing the attached portion at the attachment, the engaging portion and the engaged portion have been made capable to be engaged with each other by cutting in advance a second protruding portion that had a same shape as the compatible key and had been provided on the facing surface at a position where the second protruding portion would contact the first protruding portion at the attachment, an inside of the compatible key is hollow so as to be communicable with an inside of the toner container, and in the attaching portion, an opening that appeared in the facing surface when the second protruding portion having the same shape as the compatible key was cut, has been closed by heat welding.

2. The toner container according to claim 1, wherein the toner supply portion includes a plurality of storage portions which correspond to a plurality of colors and to each of which only a toner container storing toner of a predetermined color among the plurality of colors can be attached, a plurality of the attached portions corresponding to the plurality of colors are respectively provided in the plurality of storage portions, and in the attaching portion of a toner container storing toner of a color corresponding to a predetermined one of the plurality of the attached portions, the engaging portion of the toner container and the engaged portion of the predetermined one of the plurality of the attached portions have been made capable to be engaged with each other, by cutting in advance the second protruding portion that had been provided at a position corresponding to the color of the toner stored in the toner container, one or more second interruption keys corresponding to a color of toner in the toner container.

3. The toner container according to claim 1, further comprising:

a container main body configured to store toner inside;

an opening portion formed at an end of the container main body in an insertion direction in which the toner container is inserted in the toner supply portion; and a cover member that has a toner discharge port in a side thereof, covers the opening portion, and forms a guide path that guides the toner in the container main body from the opening portion to the toner discharge port, wherein the attaching portion is integrally formed with an end surface of the cover member at an end in the insertion direction, and the compatible key is formed on the end surface, an inside of the compatible key communicating with the guide path.

4. A toner container attachable to and detachable from a toner supply portion of an image forming apparatus, the toner container comprising:

a container main body configured to store toner inside;

an opening portion formed at an end of the container main body in an insertion direction in which the toner container is inserted in the toner supply portion;

a cover member that has a toner discharge port in a side thereof, covers the opening portion, and forms a guide path that guides the toner in the container main body from the opening portion to the toner discharge port; and an attaching portion configured to be engaged with an attached portion provided in the toner supply portion such that the toner container is selectively attached to the toner supply portion, the attached portion including a protruding boss around which at least one first protruding portion is disposed, wherein the attaching portion is integrally formed with an end surface of the cover member at an end in the insertion direction, the attaching portion includes:

a projection configured to be engaged with the protruding boss via a hole of the protruding boss, the projection formed on the end surface and projecting in the insertion direction from the end surface; and a compatible key provided on a facing surface of the attaching portion at a position where the compatible key does not contact the first protruding portion at an attachment of the toner container to the toner supply portion, the compatible key protruding from the facing surface toward the attached portion and the facing surface facing the attached portion at the attachment, and the projection and the protruding boss have been made capable to be engaged with each other by cutting in advance a second protruding portion that had a same shape as the compatible key and had been provided on the facing surface at a position where the second protruding portion would contact the first protruding portion at the attachment.

5. The toner container according to claim 4, wherein the toner supply portion includes a plurality of storage portions which correspond to a plurality of colors and to each of which only a toner container storing toner of a predetermined color among the plurality of colors can be attached, a plurality of the attached portions corresponding to the plurality of colors are respectively provided in the plurality of storage portions, and in the attaching portion of a toner container storing toner of a color corresponding to a predetermined one of the plurality of the attached portions, the projection of the toner container and the protruding boss of the predetermined one of the plurality of the attached portions have been made capable to be engaged with each other, by cutting in advance the second protruding portion that had been provided at a position corresponding to the color of the toner stored in the toner container.

6. The toner container according to claim 4, wherein an inside of the compatible key is hollow so as to be communicable with an inside of the toner container, and in the attaching portion, an opening that appeared in the facing surface when the second protruding portion having the same shape as the compatible key was cut, has been closed by heat welding.

* * * * *